US005158297A

United States Patent [19]

Johnson

[11] Patent Number: 5,158,297

[45] Date of Patent: Oct. 27, 1992

[54] GOLF CLUBS WITH INTEGRAL ALIGNMENT INDICIA

[75] Inventor: Paul C. Johnson, Spirit Lake, Iowa

[73] Assignee: Outdoor Technologies Group, Spirit Lake, Iowa

[21] Appl. No.: 628,685

[22] Filed: Dec. 17, 1990

[51] Int. Cl.[5] ..... A63B 69/36

[52] U.S. Cl. ..... 273/187.4; 273/81 B; 273/164.1; 273/163 A; 40/299

[58] Field of Search ..... 273/163 A, 183 D, 81 B, 273/162 R, 163 R, 164, 186 A; 40/299

[56] References Cited

U.S. PATENT DOCUMENTS

| | | | |
|---|---|---|---|
| 586,373 | 7/1897 | Walker | 273/67 |
| 1,126,208 | 1/1915 | Hayford | 273/163 |
| 1,433,150 | 10/1922 | Reach | 273/164 |
| 1,488,900 | 4/1924 | Armstrong | 273/163 |
| 1,604,696 | 10/1926 | Jordy | 273/164 |
| 2,003,951 | 6/1935 | Pepin | 273/164 |
| 2,771,678 | 11/1956 | Hansen | 273/194 R |
| 2,820,638 | 1/1958 | Morrison | 273/164 |
| 2,865,635 | 12/1958 | Jessen | 273/163 |
| 3,180,308 | 4/1965 | Carroll et al. | 73/849 |
| 3,249,359 | 5/1966 | Goldberger | 273/166 |
| 3,255,462 | 6/1966 | Antonious | 2/161 |
| 3,278,944 | 10/1966 | Gowers | 2/159 |
| 3,532,344 | 10/1970 | Masstab | 2/160 X |
| 3,549,300 | 12/1970 | Pelz | 273/164 X |
| 3,559,212 | 2/1971 | Skovron | 2/161 |
| 3,648,292 | 3/1972 | Strickler | 2/161 A |
| 3,684,294 | 8/1972 | Champion | 273/183 D |
| 3,826,495 | 7/1974 | Elkins | 273/164 X |
| 3,848,874 | 11/1974 | Elkins, Jr. | 273/183 B |
| 4,204,332 | 5/1980 | Gray | 273/183 D |
| 4,212,467 | 7/1980 | Shiratori | 273/163 A |
| 4,222,567 | 9/1980 | Shabala | 273/167 R |
| 4,569,525 | 2/1986 | Folger | 273/183 D |
| 4,932,659 | 6/1990 | Freeberg | 273/183 D |

*Primary Examiner*—George J. Marlo
*Attorney, Agent, or Firm*—Lance G. Johnson

[57] ABSTRACT

Golf clubs are disclosed that exhibit at least one marking indicia on the surface of the shaft and extending along at least one of the lateral sides of the shaft. The marking indicia is preferably a series of lines that are parallel to the edge of the shaft and separated by a distance sufficient to be revealed or hidden as the club face is opened or closed by small angular increments.

Golf shafts according to the invention include:

a shaft having a circular cross section and comprising
(a) a tip end for attaching a club head to the shaft,
(b) a butt end for attaching a grip to the shaft, and
(c) at least one linearly oriented first alpha marking indicia positioned on the exterior of the shaft within an angle, $\alpha$, about 45° to about 135° from a clockwise position relative to top dead center of the shaft and extending up the shaft away from the tip end for a distance sufficient to allow a golfer to view the marking indicia and discern an angular position of the club face of up to about 15° relative to a square alignment.

The present invention provides a shaft having alignment indicia that are convenient and reproducibly used to produce a square, slice, or hook shot. Having the indicia located within the lower half of the shaft reduces the need to shift focal point when viewing the indicia thereby assisting the golfer in maintaining concentration when preparing for a shot. The view focus does not need to shift from the club head to an alignment device located on or next to the hand grip. A shaft with a circular cross section permits the use of a plurality of linearly extending indicia that can be positioned to provide a variety of reproducible shots of incremental amounts of hook or slice.

9 Claims, 2 Drawing Sheets

GOLF CLUBS WITH INTEGRAL ALIGNMENT INDICIA

FIELD OF THE INVENTION

The present invention relates to golf clubs bearing alignment indicia for visually determining club head alignment and a method for using such indicia.

DESCRIPTION OF RELATED TECHNOLOGY

Since the first golf club contacted the first golf ball, club head alignment has been an issue for concern. A club face that is "open" will tend to result in a slice, and a "closed face will generally produce a hooked shot. If unintended, such results can be devastating on a course with narrow fairways, hazards, or thick rough or under windy conditions.

In other circumstances, however, some degree of slice or hook to a shot is desireable to overcome obstacles or hazards. The difficulty in executing a shot with a controlled degree of slice or hook is considerable because the angular displacement is difficult to see. In a slight cross wind, even a 1° difference with "square" can produce a substantial slice or hook.

The difficulties of discerning a slightly non-square club face are made even more difficult when the golfer's dominant eye is considered. The dominant eye is the eye that the human brain permits to control for pointing or aiming along a linear path. One simple test for determining which eye dominates is to point at an object at a remote location with a finger, hold the arm in the position where the finger appears to be pointing directly at the object, and then alternately close one eye then the other. From the dominant eye, the finger will appear to be pointing almost directly at the object. The other eye will show the finger to be pointing off to one side.

A dominant eye comes from the spatial positioning of the eyes. Human eyes are separated by a linear distance along the same plane. This separation is used by the brain to receive two images of the same object and correlate those images with a perception of depth or distance. The dominant eye is the one that provides the guiding line for alignment. The other eye provides the parallax image for depth.

In most right-handed golfers, the right eye is the dominant eye. The left eye dominates for the other right-handed golfers. The reverse is true for left-handed golfers. If a golfer doesn't know which eye is dominant, however, his or her golf game can be suffering. The eyes say that the club face is square with the ball, but the club face is actually 1°-2° open or closed. The dominant eye is fooling the golfer into believing that another source is causing the slices and/or hooks.

In an issued U.S. Patent is disclosed a golf glove having a single stripe down the top side of the thumb. This strip is intended to coordinate with a single stripe or linear indicia on the top dead center of a golf club grip. As described, aligning the indicia on the glove with the indicia on the grip permits the golfer to squarely align his or her hands for a proper shot.

The shortcoming with glove and grip alignment indicia is that a golfer's focus when addressing the ball is not at the grip. The golfer should be looking down the shaft at the club face and the ball. Minor shifts in the hand alignment or in the overlapping grip of the nongloved hand will not be recognized without looking away from the ball and back toward the grip. Such a viewing sequence can readily interrupt the golfer's concentration and preparation for the shot.

Some time ago, a putter was commercially available having a conventional shiny metal shaft in which had been placed four black lines at top dead center, 90°, 180°, and 270° around the shaft in grooves cut rather deeply into the shaft surface. The lines were up the shaft in from the putter head by about 4½ inches and were each about 2½ inches long. The lines were apparently intended for aesthetic appeal because the breadth of the indentations and their positioning at precisely the right angle positions of the shaft at the bottom of rather deep grooves with black lines on a shadow-reflecting metal shaft would have made use of these lines as positioning indicia difficult if not impossible. Moreover, such indentations in a shaft other than a putter would have so dramatically changed the flex characteristics of the shaft that a driver or fairway wood would not have responded in a manner acceptable to the average golfer.

In another U.S. Patent, there is described a putter with a rectangular shaft. Because the putter head has square faces parallel to the sides of the shaft, the putter may be used by either right or left handed players. On the front and rear surfaces of the shaft is a highly visible band which is intended to indicate whether the club face is closed, open, or squarely aligned.

The alignment system of relying on a rectangular shaft appears to be useful only for a yes/no type of determination. The use of alignment indicia on the surface of a square shaft affords no opportunity to extend the benefits of alignment indicia to other clubs or deliberately align the club face to hit a slice or hook so as to hit a reproducible shot.

In another U.S. patent there is described a golf club having a traditional cylindrical shaft having "a plurality of linear shaft marks" (illustrated as parallel, short lines near the hand grip) which are used in concert with markings on the club face to adjust the loft alignment of the club. As described, the shaft is rotated until one of the horizontal markings on the club face is perpendicular to the intended line of travel. By viewing the color of the club face marking used as indicia for loft against the shaft marking just below the hand grip and at top dead center of the shaft, the accuracy of the face alignment can be checked.

The coordinated markings between head and grip have a number of shortcomings. Because the primary loft markings are grooves on the club face, they can become obscured as dirt gathers in the grooves. The markings will also become scoured off as sand and other debris in the grooves go through the process of accumulation and removal. The indicia on the club face, therefore, have a limited life span.

The shaft markings in the design are also subject to inaccuracy and inconvenience. The inaccuracy occurs because the shaft marking corresponding to the desired loft alignment must be rotated to top dead center. This position is difficult to discern with accuracy or reproducibility. While it may not matter substantially (depending on the obstacle to be surmounted) if shot loft is a little shorter or higher than intended, rotating the shaft will also affect the line of travel of the shot. An error of even 5°-10° can send the ball in a different direction than that intended even if the loft of the shot is close to that intended. It is difficult to accurately discern during play whether a shaft marking located near the hand grip is truly at top dead center. Accordingly, the line of flight is subject to variation.

The shaft markings toward the butt end are also inconvenient to use because they are located hear the hand grip. A golfer must look away from the ball and the club face to the grip and then back to the ball to prepare for the shot. Such changes in focal point disrupt the golfer's concentration and can be fatiguing after long play.

It would be desireable to have alignment indicia on the golf club which would permit the golfer to determine the club face alignment readily and accurately.

It would also be desirable to have a golf club with marking indicia that would cooperate with the influences of the golfer's dominant eye.

It would be useful to have a golf club with marking indicia that would be readily visible on the surface of said club without materially altering the flexural characteristics of the shaft.

SUMMARY OF THE INVENTION

It is an object of the invention to provide a golf club that exhibits marking indicia that will permit a golfer to accurately position the club face for either an open, square, or closed shot in a controlled and reproducible manner.

It is an object of the invention to provide marking indicia that are readily incorporated onto the surface of golf club shafts comprising metal, graphite composite, or other composites whereby said markings are incorporated without materially altering the flexural characteristics of the shaft.

It is another object of the invention to provide a golf club with marking indicia that is visible somewhere in the lower half of the shaft section, i.e. from a location about midway between the butt and the tip.

It is yet another object of the invention to have a method for aligning a golf club face with marking indicia on the club shaft.

In accordance with these and other objects that will become apparent from reading the description herein, golf shafts according to the invention comprise:

a shaft having a circular cross section and comprising (a) a tip end for attaching a club head to said shaft, (b) a butt end for attaching a grip to said shaft, and (c) at least one linearly oriented first alpha marking indicia positioned on the exterior of said shaft within an angle, $\alpha$, about 45° to about 135° from a clockwise position relative to top dead center of said shaft and extending up said shaft away from said tip end for a distance sufficient to allow a golfer to view said marking indicia, said first marking indica being visible along at least a portion of the shaft length from said tip end to a location about midway between said tip end and said butt end.

Golf clubs according to the invention comprise:

(a) a golf club shaft having a circular cross section and exhibiting:
  (i) a tip end for attaching a club head to said shaft,
  (ii) a butt end for attaching a grip to said shaft, and
  (iii) at least one linearly oriented first marking indicia positioned on the exterior of said shaft within an angle of about 45° to about 135° and/or an angle of about 225° to about 315° from a clockwise position relative to top dead center of said shaft and extending up said shaft away from said club head end for a distance sufficient to allow a golfer to view said marking indicia, said first marking indicia being visible along at least a portion of the shaft distance between said tip and a point about midway between said tip end and said butt end; and (b) a golf club head attached to said tip end.

Methods of aligning a golf club having a club head, a shaft with a circular cross section, and a grip in accordance with the invention comprise:

rotating the shaft until the desired degree of shaft rotation is attained as measured by the appearance or disappearance along at least one lateral edge of said shaft of at least one marking indicia on the exterior of said shaft within an angle from about 45° to about 135° and/or about 225° to about 315° relative to a clockwise direction from top dead center of said shaft.

The present invention provides a shaft having alignment indicia that are convenient and reproducibly used to produce a square, slice, or hook shot. Having the indicia located within the lower half of the shaft reduces the need to shift focal point when viewing the indicia thereby assisting the golfer in maintaining concentration when preparing for a shot. A shaft with a circular cross section permits the use of a plurality of linearly extending indicia that can be positioned to provide a variety of reproducible shots of incremental amounts of hook or slice.

The use of linear indicia on either side of a shaft having a circular cross section also cooperates with the visual signals from the dominant eye to correct inaccurate alignment information due to parallax error.

DETAILED DESCRIPTION

Figure 1:
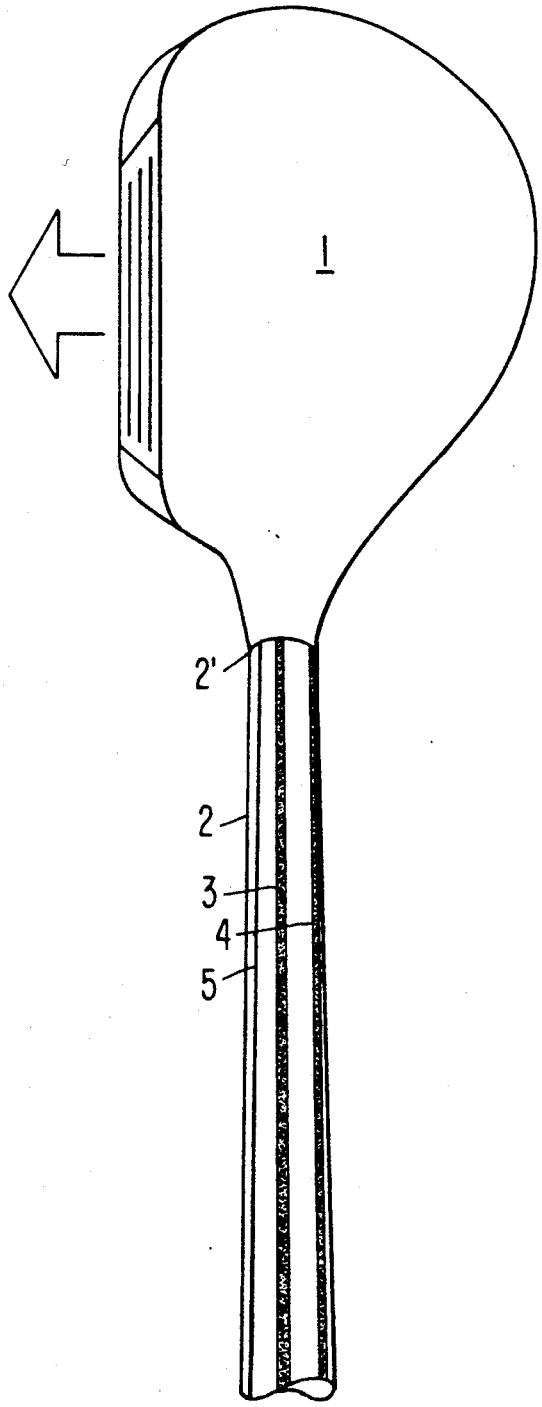
FIG. 1 is a golf club wood having a tapering cylindrical shaft exhibiting marking indicia along the left side of the shaft, top dead center, and along the right side of the shaft.

The present invention is applicable for virtually every club used for golfing. Examples of such clubs include drivers, fairway woods, irons, any of the wedges, and putters.

The present invention involves the use of at least one and preferably a series of linearly extending marking indicia on either of the lateral surfaces of a golf club shaft exhibiting a circular cross section. The phrase "linearly extending" refers to aligned indicia which cause the eye to interpret the indicia as drawing a linear relationship. Examples of linearly extending indicia include, inter alia, solid lines, an intermittent series of relatively short lines in a linear alignment otherwise recognizable as a hatched line, and a linear row of small dots. The preferred marking indicia are a series of narrow lines of a highly visible color along both sides of the shaft. The shaft preferably tapers in diameter from the butt end to the tip end along a smooth gradient, but it is within the invention to allow for a taper having one or more steps in the taper.

The marking indicia according to the invention is present on either one or both of the lateral surfaces of the shaft. From top dead center, at least one set of alpha marking indicia is present within the range from about 45° to about 135° (preferably within about 80° to about 100°) or beta indicia within the range from about 225° to about 315° (preferably about 260° to about 280°) or within both ranges. Such angular ranges will permit some flexibility in placing the indicia so that a golfer standing behind the club and focusing on the tip end of the shaft (where the club head is attached) will be able to view the indicia.

The presence of a marking indicia on both sides of the shaft cooperate with the physical separation of human eyes. The right eye will tend to focus on the right side of the shaft, and the left side will tend to focus on the left side of the shaft. The result of such focusing eliminates the problems of misalignment giving rise to hooked or sliced shots associated with misinformation from the dominant eye.

The size, width, and spacing of the marking indicia are directly related to the golfer's ability to discern a club face angular rotation. Narrow lines having a width of up to about 5–10 thousandths of an inch (0.125–0.25 mm) can be placed more closely together and provide more accurate angular information than relatively wider lines of 50–100 thousandths of an inch (1.25–2.5 mm) even if both lines are a high visibility color. The preferred thickness (if lines) or diameter (if dots) of marking indicia are desirably within a range from about 5 to about 75 thousandths of an inch (about 0.13–1.3 mm) and preferably within the range from about 10 to about 50 thousandths of an inch (about 0.25–0.75 mm) with an intermarking lateral spacing of about 5–30 thousandths (about 0.13–0.75 mm), preferably about 10–20 thousandths of an inch (about 0.25–0.5 mm).

The marking indicia are located on the external surface of the club shaft. The external surface location avoids indentations or other intrusions below the structural surface of the shaft which would alter its flexural or strength characteristics. On a metal shaft, the indicia can be printed on the surface of the shaft or can be in the form of an elongated sticker that is wrapped around the shaft. The preferred marking indicia, however, is a series of narrow lines laid down over the surface of a graphite composite shaft and covered with at least one layer of a clear lacquer. As used herein, the term "external" is intended to include indicia on the unbroken surface of a composite or metal that may be covered by a layer of clear lacquer or protective material as well as indicia printed or adhered to the outside surface of a clear lacquer layer.

It is within the invention to have colored threads or colored elements structurally or aesthetically integrated into the top layer of flat sheet composite which is ultimately formed into the shaft.

To those skilled in the art after having studied the disclosure herein, it will be readily understood that the marking indicia may be disposed on the shaft by incorporating an external sheath containing colored filaments into the laminate at the time the shaft is constructed. When the wrapping process is completed, the sheath containing the marking indicia becomes an integral part of the shaft. This shaft bearing the marking indicia may then be covered by a layer of clear lacquer or other clear protective material.

In affixing the club head to the shaft, care should be taken to ensure that the alignment indicia accurately reflect a square alignment. Techniques to ensure such alignment presently exist in one having an ordinary skill level in the art. The preferred method of assuring accurate alignment, however, employs a jig to hold the club head. On or extending over the jig (depending on whether the marking indicia start from the attachment at the club head or a short distance above the head) is a set of markings which will align with the marking indicia on the shaft when the club is correctly aligned.

When marking indicia according to the present invention are applied to finished clubs as labels bearing the marking indicia or some other form of transfer printing, proper alignment may be determined by "best guess" visual inspection using a TDC mark as a guide or mechanical means may be used. A preferred aligning mechanism for use on finished clubs is an alignment pattern which may be projected over the shaft surface. The marking indicia are then positioned according to the projected pattern.

The alpha and/or beta marking indicia may be located along the shaft at any location that is readily viewable by the golfer when addressing the ball. For convenient viewing of the marking indicia while preparing for a shot, the indicia are visible on the shaft along at least a portion of the lower half of the club shaft, i.e. at least a portion of the section between the tip and a point midway between the tip and the butt end. Preferably, at least some portion of the indicia are visible on the surface of the lower 25% of the shaft, i.e. from the tip end to 25% of the distance toward the butt end.

EXAMPLE

A putter according to the invention was prepared by silk screening a plurality of lines as marking indicia on an otherwise unmarked, tapered, graphite shaft having a circular cross section. A single line was positioned at top dead center. Fluorescent yellow lines of about 40 mils (0.040 inches) were positioned on either side of the shaft from about 4 inches away from the head to a position about 7 inches away from the bottom of the handgrip. Two additional lines were placed on each side of the shaft (one above and the other below) and spaced about 20 mils apart (at the point closest to the head) from the lines at 90° and at 270°. At the end of the indicia closest to the head, the shaft has an exterior diameter of about 0.40 inches. Because of the taper in the shaft, the lines appear to be on a converging path as they extend closer to the head.

The indicia aid in club face alignment and viewing alignment because one set of lines appears and the other disappears as the shaft is turned. Proper viewing alignment is assured because the golfer will naturally adjust head position until a line is seen on either side of the shaft. The natural parallax error induced by the human eye placement is thereby avoided, and the club is reproducibly aligned.

The present invention is conveniently explained with reference to the attached drawings. FIG. 1 shows club head 1 for a right-handed golfer attached to shaft 2. Shaft 2 will have a butt end (not shown) on which a grip is placed and a tip end 2' where club head 1 is affixed. Shaft 2 can be parallel or tapered and can be made of virtually any material according to the invention (e.g., metal, graphite, boron-graphite composite, etc.) but is preferably made from a composite material such as a graphite or boron-graphite composite that does not have step changes in the shaft diameter.

According to the invention, at least one set of marking indicia is placed on either side of shaft 2. As shown, shaft 2 bears three marking indicia in the form of narrow lines-top dead center (TDC) indicia 3, first alpha indicia 4 at about 85° from TDC, and first beta indicia 5 at about 275° from TDC. First alpha indicia 4 and first beta indicia 5 are preferably disposed on the surface of shaft 2 so as to be visible simultaneously when the club face is square or is either open or closed by a degree of rotation with a gradation within about 1° to about 15°, preferably within about 2° to about 10° rotation. The indicia may be placed directly on the exterior of a finished shaft, i.e., above the conventional lacquer coating, but the indicia is preferably disposed on the shaft so as to be protected by at least one clear protective layer of lacquer. If more than one alpha indicia and beta indicia are used, the indicia markings should be color coordinated to have a common color marking visible upon a given rotation, e.g., a square alignment has both alpha and beta lines of a blaze orange color visible, but a 5° open alignment has the fluorescent green alpha and beta indicia visible.

It is within the invention, though, for the alpha and beta marking indicia to be offset from each other in angular position to increase the fineness of the angular positioning measurements. Such an embodiment would position the alpha indicia at one angular position and the beta indicia at another angular position with appropriate color differentiation for accurate viewing of the angular positioning in an increment within about 1° to about 15°, preferably within about 2° to about 10°. An example of such an arrangement would have a plurality of alpha indicia at every 5° of rotation and a plurality of beta indicia but starting at a 3° rotation and having subsequent indicia in increments of 5° thereafter. The golfer could then determine the alignment of the club face to within a 2° accuracy where it might otherwise be difficult to achieve such accuracy due to indicia width (W in FIG. 2), color printing requirements, or any other reason that might limit the placement of indicia. The indicia may be so offset that a club face positioning accuracy may be within virtually any increment. Preferably, that increment is within the range from about 1° to about 15°, most preferably within about 2° to about 10°.

In any event, the alpha and beta indicia should reflect a color that is readily visible on the surface of the shaft. As a general rule, glossy black indicia are to be avoided on metal shafts because the markings are too easily confused with shadows on the shaft surface and are too difficult to distinguish from the shadow cast by the edge of the shaft against the ground by a strong light source. Such admonitions against black or dark markings apply equally to composite shafts of the conventional black or dark gray color. Certainly, it should be considered as within the present invention to provide a light colored shaft that uses relatively dark markings as long as the markings are visible along the sides of the shaft as the shaft is rotated.

Preferred colors for the alpha and beta indicia are those that are readily visible against the shaft accounting for the effects of bright light and shadows. Most of the fluorescent colors such as a fluorescent blue, green, yellow, red, and orange are useful in the present invention as well as the readily discernible nonfluorescent colors falling between red and green. The most preferred colors are fluorescent red, orange, yellow, chartreuse, and other colors having a wavelength within the range from about 480–580 nm which are the colors to which the human eye is most sensitive.

Turning back to FIG. 1, indicia 3–5 extend up along shaft 2 from tip end 2. It is within the invention, however, for indicia 3–5 to begin at a some offset distance from tip end 2' such as in FIGS. 2 and 3. Suitable offset distances are up to about 8 inches, preferably up to about 6 inches.

Figure 2:
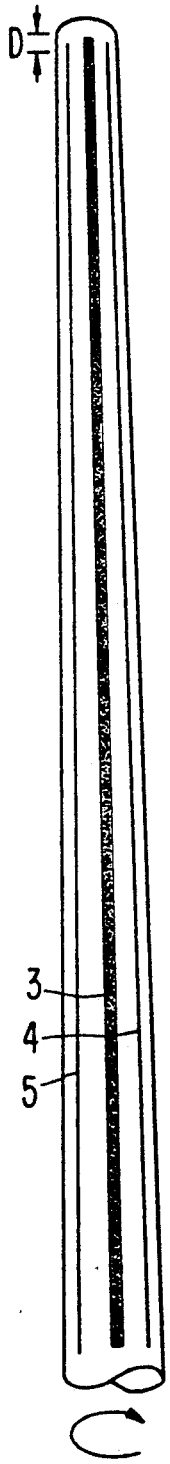
FIGS. 2 and 3 show the appearance of a tapering cylindrical club shaft with the marking indicia of FIG. 1 when the shaft square and open, respectively.

The alignment depicted in FIGS. 1 and 2 is the view a right-handed golfer would observe when club head 1 is aligned for a straight, square shot. Both the alpha indicia and the beta indicia are visible in the lower half of the shaft and on either side of the shaft. The indicia can be readily viewed by the golfer while lining up the club head without having to look away at indicia located further up on the shaft. For aesthetic purposes, the TDC, alpha, and beta indicia can extend up the shaft toward the grip for a distance sufficient to be viewed by the golfer, e.g., about 5–100% of the shaft length. Where the alignment indicia extend up to the grip, the TDC marking can be used to assist the golfer in properly aligning the control hand on the grip as in U.S. Pat. No. 3,848,874.

Figure 3:
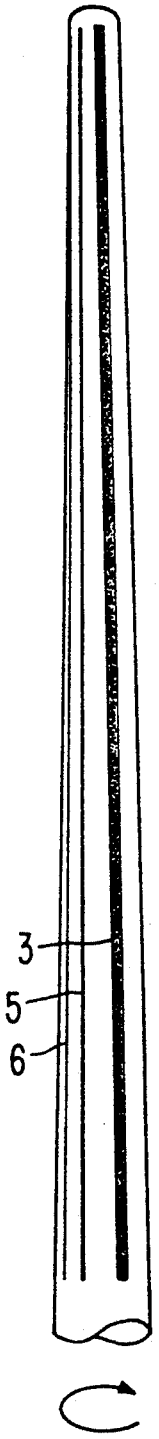

FIG. 3 shows the view observed when the club face is opened more than 5° (using the angular positioning of FIGS. 1 and 2) from square. As shown, first alpha indicia 4 disappears and first beta indicia 5 appears to have rotated upwardly thereby exposing second beta indicia 6 along the beta edge of shaft 2. For maximum visibility, first and second beta indicia are preferably solid narrow lines of different fluorescent colors such as fluorescent chartreuse and fluorescent orange, respectively.

Figure 4:
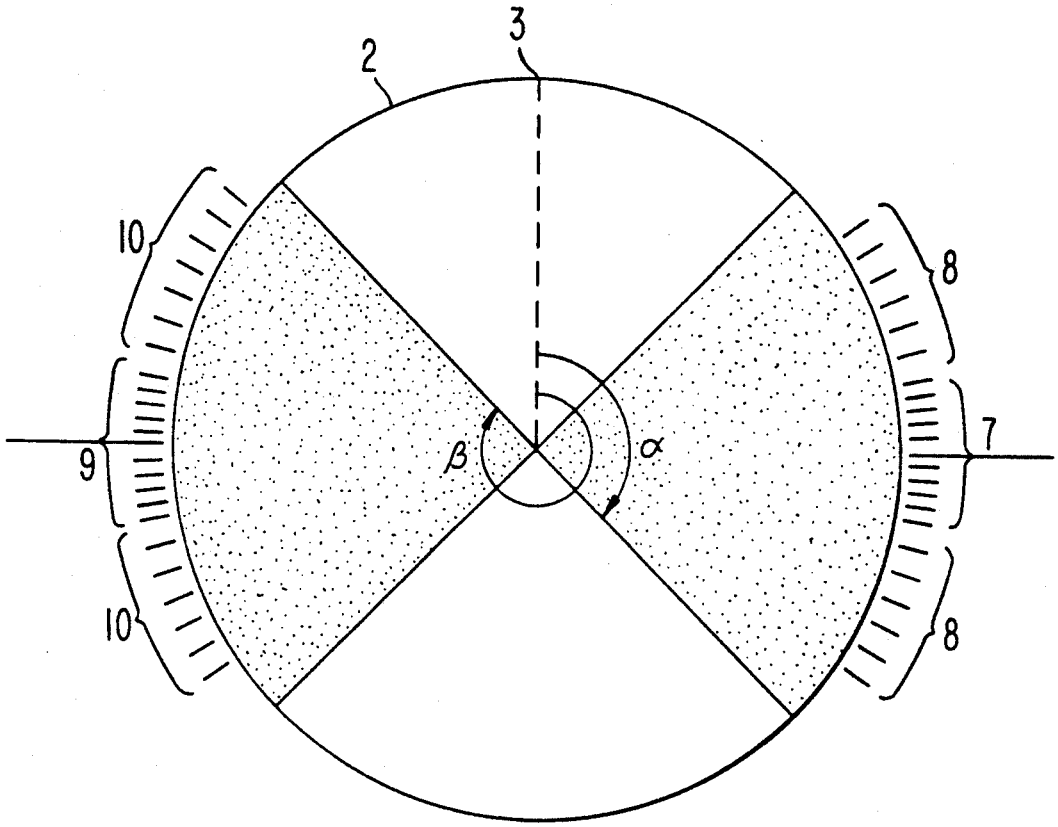
FIG. 4 depicts a view down the center of a tapering cylindrical shaft to illustrate the positioning of marking indicia according to the invention.

FIG. 4 depicts an axial view of shaft 2 with the range of locations for alpha and beta indicia in shading. Top dead center indicia 3 is the reference site for measuring the angular position of the alpha and beta indica although shafts according to the present invention need not bear an actual TDC indicia. A plurality of alpha and beta indicia may be located at constant angular positions or in groups of different positions. As shown, group 7 of alpha indicia may be located at a narrow increment of 2° from the 90° position for fine angular alignment differences close to a square alignment but change to a relatively coarser increment grouping 8 of, e.g., about 4° for hook or slice shots. Similar groupings can be used for the beta indicia-fine angular increment group 9 near the 270° position and relatively coarser indicia increments 10 either coordinating or with the relatively coarser increment grouping 8 of alpha indicia or offset therefrom.

In its most preferred embodiment, the primary indicia along each side of the shaft used for determining a square alignment are disposed at an angle within the range from about 80° to about 90° and within the range from about 270° to about 280°. These locations place the indicia on the upper half of the shaft, i.e. on the side of the shaft viewed by the golfer when preparing for a shot, at a position that does not require the lines to span the 90° and 270° tangent points of the shaft which can cause the marking indicia to be lost against certain background colors. By positioning the indicia on the top half of the shaft and by accurately controlling the indicia width, the edge of the indicia can be positioned to appear to coincide within 1 or 2 degrees of the lateral edge of the shaft. Square alignment is thereby viewed as the appearance of lines at either side of the shaft with perhaps a slight gap between the outside of the lines and the edge of the shaft.

Figure 5:
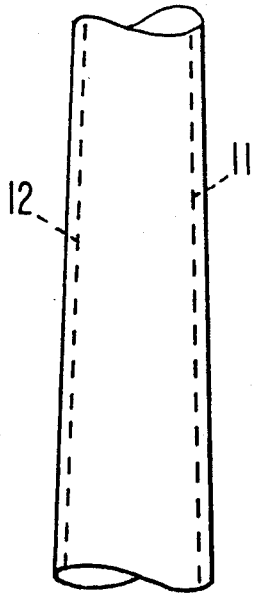
FIG. 5 illustrates linearly extending marking indicia exhibiting the form of intermittent narrow lines.

FIG. 5 depicts alpha indicia 11 and beta indicia 12 as an aligned series of short, intermittent lines, i.e. a hatched line.

Figure 6:
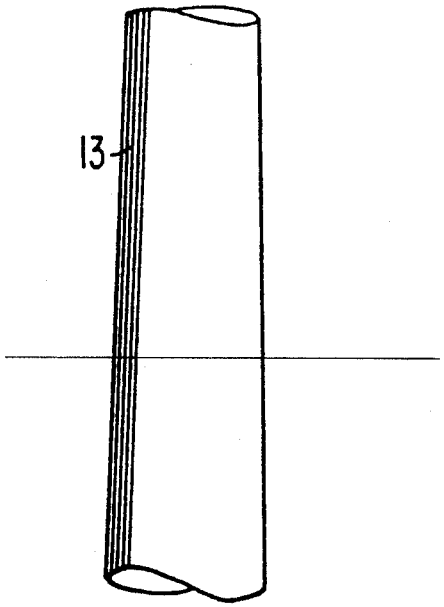
FIG. 6 shows a series of narrow lines spaced equidistant at a given distance from the tip end and equidistant from the outside edge of a cylindrical shaft whereby the appearance or disappearance of one or more lines permits measurement of the positioning of the club face relative to a square position.

FIG. 6 is a shaft having four beta indicia 13 in the form of narrow solid lines. Preferably, at least three of these lines are of different colors. In operation, a golfer would assume a normal grip and address in a normal fashion. The golfer then views the alignment indicia visible on either or both sides of the shaft. Depending on the indicia visible and the type of shot desirably hit, the golfer would rotate the shaft and club face to make one or more of the alignment indicia appear or disappear as needed until the desired degree of club face rotation is attained. The posture of the club face is thereby accurately measured and can be mentally noted for reproducibility by viewing the marking indicia on the exterior of the shaft.

Although the invention has been described with reference to the attached drawings, elements and features shown in these figures should be considered as assisting in an understanding of the invention. Features and elements in the figures should not be construed as limiting the scope of the appended claims.

I claim:

1. A golf club shaft exhibiting:

(a) a tip end for attaching a club head to said shaft, (b) a butt end for attaching a grip to said shaft, (c) a cross section having the shape of a circle, and (d) marking means for discerning increments of angular rotation within the range from 1° to 15° of said shaft from alignment in a predetermined position said means comprising linearly extending marking indicia on either or both of the lateral external surfaces of said shaft relative to a top dead center surface position on said shaft and extending up said shaft away from said tip end for a distance sufficient to allow a golfer to view said marking means from said butt end along at least a portion of the shaft distance between said tip end and a point midway between said tip end and said butt end.

2. A shaft as in claim 1 wherein said means for discerning increments of angular rotation comprises at least two lines spaced apart from each other.

3. A shaft as in claim 2 wherein said at least two lines are visible on said shaft within an angle, $\alpha$, of 45° to 135° from a clockwise position relative to top dead center of said shaft.

4. A shaft as in claim 2 wherein said at least two lines are visible on said shaft within an angle, $\beta$, from 225° to 315° relative to top dead center of said shaft.

5. A shaft as in claim 2 wherein the lines exhibit a width within the range from 5 to 75 thousandths of an inch.

6. A shaft as in claim 1 wherein said means for discerning increments of angular rotation comprises: (a) at least two lines spaced apart from each other within an angle, $\alpha$, of 45° to 135° from a clockwise position relative to top dead center of said shaft; and (b) at least two lines spaced apart from each other within an angle, $\beta$, from 225° to 315° relative to top dead center of said shaft.

7. The shaft of claim 1 wherein said shaft comprises graphite.

8. The shaft of claim 1 wherein said shaft exhibits a taper in diameter from said butt end to said tip end.

9. A shaft as in claim 1 further comprising a linearly extending marking indicia along said top dead center position at said tip end.

* * * * *